US009874076B2

(12) United States Patent
Christensen et al.

(10) Patent No.: US 9,874,076 B2
(45) Date of Patent: Jan. 23, 2018

(54) TOOL ARRANGEMENT CONNECTED TO A CHRISTMAS TREE AND METHODS FOR INSTALLING AND REMOVING OF A CHRISTMAS TREE

(71) Applicant: Aker Solutions AS, Lysaker (NO)

(72) Inventors: Kim W. Christensen, Hyggen (NO); David Brown, Oslo (NO)

(73) Assignee: Aker Solutions AS, Lysaker (NO)

( * ) Notice: Subject to any disclaimer, the term of this patent is extended or adjusted under 35 U.S.C. 154(b) by 0 days.

(21) Appl. No.: 15/120,185

(22) PCT Filed: Mar. 25, 2015

(86) PCT No.: PCT/NO2015/050055
§ 371 (c)(1),
(2) Date: Aug. 19, 2016

(87) PCT Pub. No.: WO2015/147651
PCT Pub. Date: Oct. 1, 2015

(65) Prior Publication Data

US 2017/0067324 A1 Mar. 9, 2017

(30) Foreign Application Priority Data

Mar. 25, 2014 (NO) ..... 20140382

(51) Int. Cl.
*E21B 33/035* (2006.01)
*E21B 33/076* (2006.01)
*E21B 41/04* (2006.01)

(52) U.S. Cl.
CPC ..... *E21B 41/04* (2013.01); *E21B 33/035* (2013.01)

(58) Field of Classification Search
CPC ..... E21B 33/035; E21B 33/076; E21B 41/04
See application file for complete search history.

(56) References Cited

U.S. PATENT DOCUMENTS 4,821,799 A * 4/1989 Wong ..... F16J 15/40 166/385
5,161,620 A * 11/1992 Ritter, Jr. ..... E21B 17/01 166/359

(Continued)

FOREIGN PATENT DOCUMENTS

WO WO-0155550 A1 8/2001
WO WO 2006061645 A1 * 6/2006 ..... E21B 19/002

(Continued)

OTHER PUBLICATIONS

Toll, Anders, "International Search Report," prepared for PCT/NO2015/050055, dated Jul. 17, 2015, four pages.

*Primary Examiner* — Matthew R Buck
(74) *Attorney, Agent, or Firm* — Winstead PC

(57) ABSTRACT

The invention provides a multipurpose tool arrangement for riserless invention of a subsea well. The multipurpose tool (40) which is adapted to be connected at the lower end to a Christmas tree (50) which has a tubing hanger (52) and an annulus bore (60') being defined through said tubing hanger (52). Said tool (40) comprises a tubular element (48) and a Christmas tree connector (41), said multipurpose tool (40) is adapted to receive a second tool (64), which is operated by a cable (49), said second tool (64) in turn being adapted to install a plug (70) in said tubing hanger annulus bore (60'), through said multipurpose tool (40), said arrangement also comprising a pressure control head (47) through which said cable (49) extend. The invention also provides a method for removal or installing of a Christmas tree.

19 Claims, 12 Drawing Sheets

(56) References Cited

U.S. PATENT DOCUMENTS

| | | | | |
|---|---|---|---|---|
| 6,719,059 | B2 * | 4/2004 | Dezen | E21B 19/002 166/125 |
| 6,843,321 | B2 * | 1/2005 | Carlsen | E21B 19/002 166/355 |
| 7,121,344 | B2 * | 10/2006 | Fenton | E21B 19/002 166/106 |
| 8,028,752 | B2 * | 10/2011 | Richards | E21B 23/06 166/181 |
| 8,047,295 | B2 * | 11/2011 | Skeels | E21B 33/076 166/338 |
| 8,684,089 | B2 * | 4/2014 | Borhaug | E21B 7/124 137/15.04 |
| 8,869,899 | B2 * | 10/2014 | Caulfield | E21B 33/043 166/179 |
| 8,978,767 | B2 * | 3/2015 | Machin | E21B 33/068 166/338 |
| 9,010,432 | B2 * | 4/2015 | Edwards | E21B 23/04 166/338 |
| 9,109,419 | B2 * | 8/2015 | Fenton | E21B 33/035 |
| 9,169,714 | B2 * | 10/2015 | Edwards | E21B 33/076 |
| 9,234,393 | B2 * | 1/2016 | Edwards | E21B 17/01 |
| 2009/0236100 | A1 * | 9/2009 | Lawson | E21B 33/043 166/339 |
| 2011/0094749 | A1 * | 4/2011 | Richards | E21B 33/076 166/345 |
| 2012/0043089 | A1 | 2/2012 | Hoffman et al. | |
| 2012/0273219 | A1 | 11/2012 | Hoffman et al. | |

FOREIGN PATENT DOCUMENTS

| | | | |
|---|---|---|---|
| WO | WO-2010/032019 | A1 | 3/2010 |
| WO | WO-2011036175 | A1 | 3/2011 |

* cited by examiner

TOOL ARRANGEMENT CONNECTED TO A CHRISTMAS TREE AND METHODS FOR INSTALLING AND REMOVING OF A CHRISTMAS TREE

FIELD OF THE INVENTION

The present invention relates to an open water workover system for use with a subsea well. In particular the invention relates to a plug running tool with access to the tubing hanger annulus for intervention. The tool could also function as a tree running tool for removing or retrieving a Christmas tree.

BACKGROUND OF THE INVENTION AND PRIOR ART

FIG. 1 is an overview of an open water workover system 1 according to prior art. The system 1 is a set of equipment which is installed on top of a Christmas tree (XT) 2 and allows safe intervention operations in a hydrocarbon containing well (not shown). A well control package (WCP) 3 also named lower riser package (LRP) is connected to the top of Christmas tree 2. At the top of the lower riser package (LRP) 3, an emergency disconnect package (EDP) 4 is attached. A workover riser 5 is extending from a drilling rig 6 on the sea level 7 down to the emergency disconnect package 4.

FIG. 2 shows a typical setup for a prior art horizontal Christmas tree 10 with a monobore workover system 11. In this setup a monobore or workover riser 12 extends from the rig (only the lower part of the riser is shown) down to a monobore emergency disconnect package (EDP) 13 and lower riser package (LRP) 14. The lower riser package 14 is connected to the horizontal Christmas tree 10 through a Christmas tree adaptor connector (XTAC) 15. The Christmas tree 10 is in the other end connected to a wellhead 16 and a tubing hanger 17 sits in the Christmas tree in conventional manner for horizontal Christmas trees 10. The emergency disconnect package 13, the lower riser package 14 and the Christmas tree adaptor connector 15 are constituting the monobore workover system 11. The system is referred to as monobore due to a single, straight main bore 18*a* that runs down the centre of the system and is adapted to correspond with a main bore 18*b* in the horizontal Christmas tree 10. An annulus bore 26 encloses the main bore 18*b* in the horizontal Christmas tree 10. The horizontal Christmas tree 10 has a horizontal production outlet 19 where the production flow is routed. This outlet 19 is closed during the workover process by valves 20. When the workover system 11 is attached to the Christmas tree 10, tools (not shown) can be lowered and hoisted through the riser 12 and main bore 18*a*, 18*b* in order to perform different tasks in the well.

In FIG. 2 an annulus line 21 is arranged beside the main bore 18*a* in the workover system 11. The annulus line 21 starts as a hose (not shown) from topside and enters the emergency disconnect package at the top part 22 before taking a varied path down through the system and into the Christmas tree 10. There are several valves in the annulus line 21 and several crossover points 23 from the annulus line 21 into the main bore 18*a*, creating circulation paths that can be used for various operations. The line 21, valves 24 and crossover points 23 can together with valves 25 in the main bore 18*a* for instance be used for flushing of hydrocarbons from the riser 12.

FIG. 3 shows a typical setup for a prior art vertical Christmas tree 31 with a similar monobore workover system

11 as in FIG. 2, but includes a passive bore selector 32. The vertical Christmas tree has a configuration with a production bore 33 and annulus bore 34. When using a monobore workover system on the vertical Christmas tree 31 it is therefore required to use a bore selector technology, either a passive or an active bore selector, to match the configuration of the vertical Christmas tree. The workover system 30 in FIG. 3 has a similar structure than the monobore workover system 11 in FIG. 2, except that there is arranged a passive bore selector 32 between the lower riser package and the vertical Christmas tree 31. The main bore 18*a* in the lower riser package 14 is adapted to correspond with the production bore 33 in the vertical Christmas tree 31 through the passive bore selector 32. The same applies to the annulus line 21 in the lower riser package 14 which is adapted to correspond to the annulus bore 34 in the vertical Christmas tree 31. The Christmas tree 31 is in the lower end connected to a tubing hanger 35 and a wellhead 36 in a conventional manner for vertical Christmas trees 31

With use of the passive bore selector 32 the whole riser system must be pulled to the surface in order to change bore selector.

The present invention is applicable both on Vertical Christmas Trees (VXT) as well as other types of Christmas trees. In the Figures illustrating the invention there are shown a vertical Christmas tree and the invention will be further described for this use, but the invention is not limited only to vertical Christmas tree, but is also applicable for other types of Christmas trees, such as hybrid Christmas trees, horizontal Christmas trees or other possible types of Christmas trees.

To retrieve or deploy a Vertical XT, it is required to set plugs in the Tubing Hanger—one plug in the main bore and one plug in the annulus bore.

Traditionally this has been done using either a dual bore workover system or a monobore workover system with active or passive bore selectors, as described in FIG. 3.

A dual bore work over system has several limitations—especially on the Emergency Disconnect Package (EDP) and Lower Riser Package (LRP) design. The two bores need to be straight to allow straight access to the Christmas tree and the tubing Hanger. Different bore configurations in the XT will require the same corresponding bore configuration in the EDP/LRP, hence making standardization of the EDP/LRP design difficult. A dual bore system also requires an extra 2" riser in addition to the normal main bore riser—something that can lead to a reduced operational window along with increased wellhead fatigue. Some special joints, like a safety joint or a heave eliminator are very complex to make for a dual bore system.

Using a monobore workover system requires the use of bore selector technology. A passive bore selector is an alternative connector assembly that can be used that offsets the whole lower workover riser package (WRP) stack, i.e. EDP and LRP to align the main bore over the annulus bore to give the required access. A passive bore selector has traditionally been chosen due to the reliability and the small size, but the operational efficiency is greatly reduced since the whole riser stack must be pulled to the surface in order to change the bore to be intervened.

An active bore selector allows wireline tools to be redirected from the main bore in the EDP to either the main or the annulus bores in the LRP, with a path that is straight enough for the wireline tools to navigate. Using an active bore selector has shown to add complexity to an already complex system, and it is required to use a flexible jarring tool for setting of the annulus plug due to the "dog leg"

going from main to annulus bore. The risk for getting stuck with the jarring tool, or failing with the jarring due to lack of force transfer is greatly increased through a "dog leg". In addition, an active bore selector will typically add weight and height to a system that is already above the weight/height limitations stated in commonly used standards.

With both of the above arrangements, this creates a heavier, more complicated and more expensive system design. Therefore, the invention proposed is aimed to solve this problem by creating a separate tool that can be deployed to perform the annulus plugging/removal operation when necessary.

SUMMARY OF THE INVENTION

The invention provides a multipurpose tool for riserless intervention of a subsea well which tool is adapted to be connected in the lower end to a Christmas tree, said Christmas tree having a tubing hanger, an annulus bore being defined through said tubing hanger. The invention is distinctive in that said tool comprises a tubular element and a Christmas tree connector, said multipurpose tool is adapted to receive a second tool, which is operated by a cable, said second tool in turn being adapted to install a plug in said tubing hanger annulus bore, through said multipurpose tool, said second tool comprising a pressure control head through which said cable extend Preferable embodiments of the plant are defined in the dependent claims 2-19, to which reference are made.

The invention also provides a method for riserless removal of a Christmas tree and a tubing hanger attached to a wellhead, said tubing hanger having a production bore and an annulus bore, the method comprises a standard plugging in the tubing hanger production bore with a standard workover system. The method is distinctive in that it further comprising the following steps:

- removing of the standard workover system,
- lowering a multipurpose tool with a lifting member attached to a connector at the top of said multipurpose tool,
- connecting the multipurpose tool to the Christmas tree,
- removing the lifting member from the connector and attaching a pressure control head with a wireline or cable operated second tool to the connector at the top of the multipurpose tool,
- plugging of the tubing hanger annulus bore with said second tool,
- removing the pressure control head from the connector and attaching the lifting sub member to the connector at the top of the multipurpose tool.
- removing of the Christmas tree from the wellhead with the multipurpose tool and the lifting member The invention also provides a method for installing a Christmas tree in a subsea well comprising a tubing hanger landed in a wellhead, said tubing hanger having a production bore and an annulus bore. The method is distinctive in that it further comprising the following steps:

- connecting a multipurpose tool to a Christmas tree,
- connecting a lifting sub to a connection flange at the top of the multipurpose tool,
- lowering the multipurpose tool with the Christmas tree to a wellhead,
- connecting the Christmas tree to the wellhead,
- removing the lifting sub member from the connection flange and connecting a pressure control head with a slick line operated second tool to the connection flange at the multipurpose tool,
- removing a plug from the tubing hanger annulus bore with said second tool,
- removing the pressure control head from the connector and connecting the lifting member to the connection flange at the top of the multipurpose tool,
- removing the multipurpose tool with use of the lifting member,
- lowering a standard workover system to the Christmas tree for removing a plug in a tubing hanger production bore.

The invention allows setting of annulus plugs in the Tubing Hanger on Christmas tree systems and is also designed to work as a Tree Running Tool. The invention allows straight access to the annulus bore to set plugs in the Tubing hanger and will therefore solve the challenges a monobore open workover system has with gaining access for setting plugs or other operations in the annulus bore in the Tubing hanger.

The Tree Running and Annulus Plugging Tool (TRAPT) invention will allow the use of a monobore work over system, without the use of bore selector (active or passive) and without reducing the operational efficiency. The invention consists of the same functionality as a Christmas tree Running Tool (TRT) but also enables plugging of the annulus bore in the Tubing Hanger without the use of any bore selectors. The monobore workover riser system will be used normally for operations in the main bore, but when it is time to retrieve the Christmas tree to the surface, the workover system is retrieved before the annulus bore has been plugged. The Christmas tree valves will be closed before retrieving the Christmas tree To be equal in operational efficiency to a bore selector system or a dual bore riser system, the TRAPT will also function as a Tree Running Tool (TRT).

Normally the Christmas tree is deployed or retrieved using a dedicated tree running tool (TRT). Using the TRAPT as a tree running tool (TRT) as well eliminates one run and the operational efficiency will be similar to the open water Work over System.

The TRAPT is believed to be a technologically simpler concept than the alternative of using a bore selector. It is also considered to have reduced risk when it comes to development due to the use of known technology, and also reduced risk for the operation since it has straight access to the annulus bore (no "dog leg" as is true for a bore selector) and hence less chance for stuck tool and/or failed jarring.

The TRAPT is also believed to be a technology of lighter weight than the traditional workover systems. The advantages of using the TRAPT is also that by using a lighter system the wellhead is exposed to less fatigue loading in less amount of time than with a traditional system. The Christmas tree could have a longer lifetime due to the reduced weight.

The TRAPT has also less height than the traditional workover system because the system does not require any active or passive bore selector.

BRIEF DESCRIPTION OF THE DRAWINGS

The invention will now be described by way of example with reference to the accompanying drawings, throughout which like parts are referred to by like references, and in which.

DETAILED DESCRIPTION OF THE DRAWINGS

Figure 4:
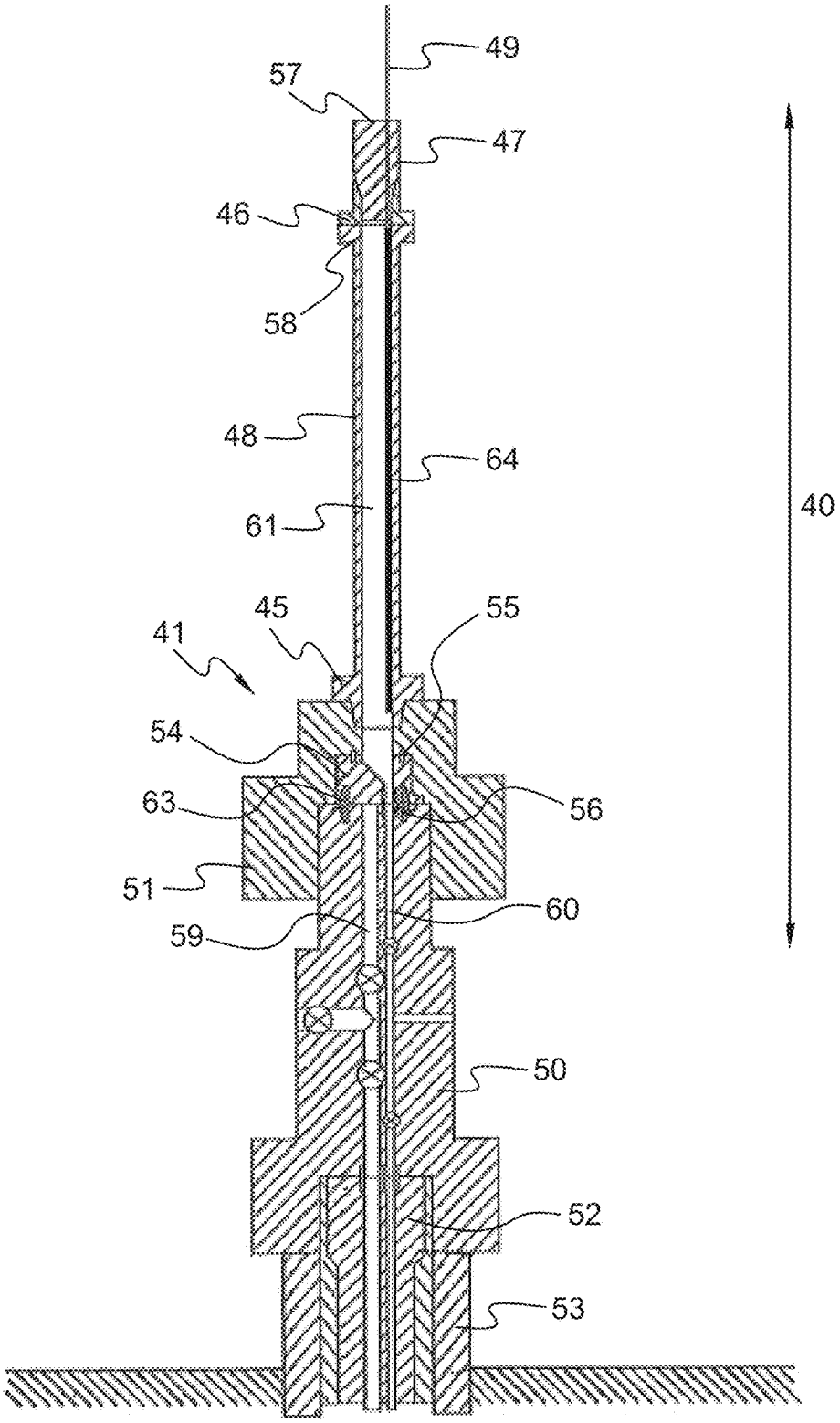
FIG. 4 is a schematic view of the tree running and annulus plugging tool arranged on top of a vertical Christmas tree.

FIG. 4 shows schematically the tree running and annulus plugging tool (TRAPT) 40 according to the present invention. The tool 40 comprising a tubular member called a lubricator 48 with an internal large bore 61. The lubricator 48 having a flanged interface 45 in the bottom of the lubricator 48 to a standard Christmas tree connector 41, and at the top of the lubricator there is a connection flange 46 towards a male connector of a pressure control head (PCH) 47. A cable 49 or an e-line, braided wire, rope, slick line or similar is shown at the top of the pressure control head (PCH) 47 extending through the TRAPT 40. The pressure control head 47 has a stuffing box or a pressure controlling elements for a slick line (not shown). There are also arranged control umbilical from the topside, lines to the pressure control head 47 from the Christmas tree and flying lead to the Christmas tree. (Not shown on the figure)

The tree running and annulus plugging tool (TRAPT) 40 is in the FIG. 4 shown attached on top of a vertical Christmas tree 50, the Christmas tree is at the bottom attached in conventional manner to a tubing hanger 52 and a wellhead 53. The standard Christmas tree connector 41 comprising a standard Christmas tree adaptor connector 51 with an inner member 54 that is replaceable. The replaceable member 54 could have different bore configurations in the interface between the replaceable member 54 and the Christmas tree 50 to match different configurations of production bores 59 or annulus bores 60 in the Christmas tree 50. This will enable access to different Christmas trees 50 without changing the Christmas tree adaptor connector 51. The replaceable member 54 can be bolted inside the connector adaptor 51 and could have standard BX seals 55 at an interface 85 (FIG. 7) towards the Christmas tree adaptor connector 51 and Christmas tree specific seals 56, 63 at an interface 86 (FIG. 7) towards the Christmas tree 50. This is explained further in FIG. 7.

The replaceable member 54 can also be changeable subsea by using an ROV (not shown).

The Christmas tree adaptor connector 51 having an internal annular large bore 62 with same size as the large bore 61 of the lubricator 48, the bore 62 and bore 61 being in contact with each other. The upper interface of the replaceable inner member 54 is optimized to fit the configuration of the annular passage 62 in the Christmas tree adaptor connector 51.

Figure 3:
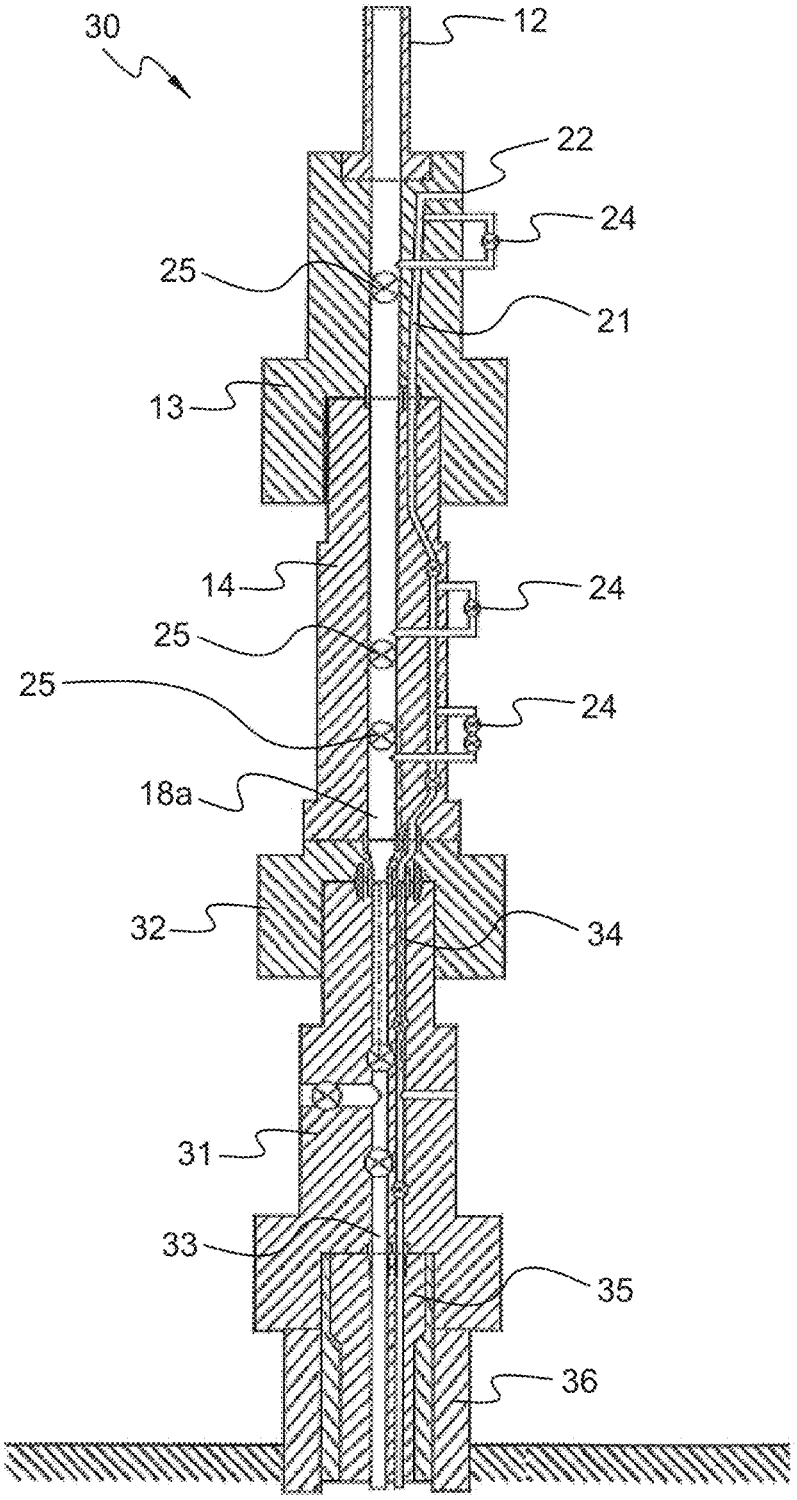
Fig. 3 (Prior Art)
FIG. 3 is a schematic view of a standard open water workover system on a vertical Christmas tree according to prior art.

This concept could also be used as an alternative to the Christmas tree adaptor connector 32 in the passive bore selector in FIG. 3. The Christmas tree adaptor connector 51 can be the same going on all Christmas trees with standard H4 profile hubs, and only a stinger seal in the horizontal Christmas trees or the replaceable member 54 as described above in vertical Christmas trees 50 needs to be replaced. The connector 32 can then be an integral part of the lower riser package (LRP) spool 14 to reduce height and remove leakage points.

Figure 1:
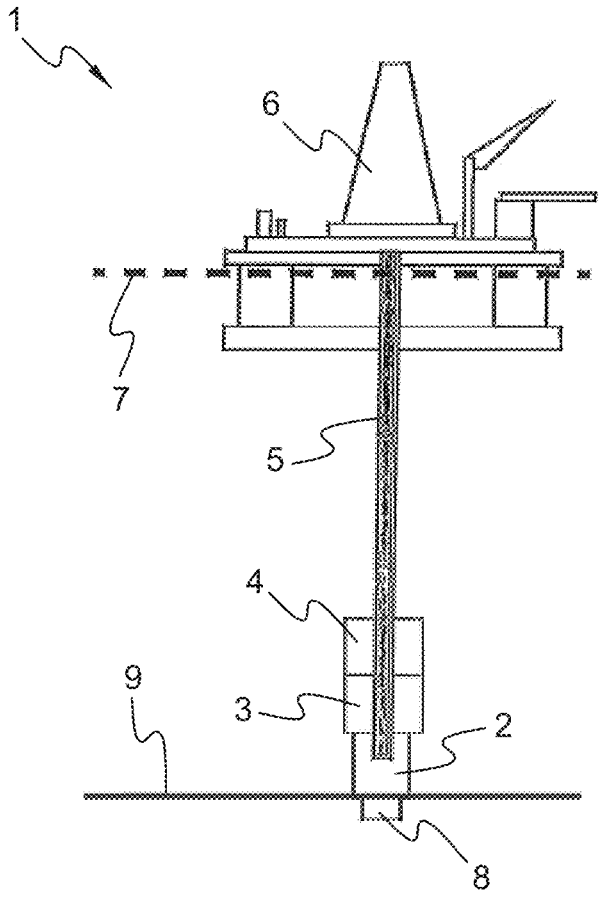
Fig. 1 (Prior Art)
FIG. 1 is an overview of an prior art open water workover system.

The cable or slick line 49 is in FIG. 4 shown extending from a rig, a platform, a well intervention ship or similar at the surface 7 (FIG. 1) through an opening 57 in the pressure control head 47 and attached to a tool 64 that is led down through the lubricator 48, the Christmas tree adaptor connector 51 with the replaceable inner member 54, the Christmas tree 50 and into the tubing hanger 52 to set a plug 70 (FIG. 11*d*) in the tubing hanger 52 or performing operations in the well. The cable or slick line 49 is arranged in pressure controlling elements or a stuffing box (not shown) in the pressure control head (47), the stuffing box is adapted to seal around the cable or slick line 49 while the cable or slick line 49 is lowered through the pressure control head 47. This embodiment of the TRAPT has no cutting valves since the cable or slick line 49 is not capable of transferring dangerous bending loads to the Christmas tree 50 and the wellhead 53. The cable or slick line 49 will therefore act as a weak link itself. The pressure control head 47 will be equipped with a ball check function that will close the pressure control head 47 in case the slick line 49 is broken. This is a standard function on a pressure control head, and is not shown on the drawings.

The connection flange 46 on top of the lubricator 48 will enable connection of both the pressure control head 47 and the running tool for the TRAPT. The TRAPT and the running tool will be dimensioned to carry the weight of a complete Christmas tree in order to function as a Tree Running Tool (TRT). The lubricator 48 will be positioned in the center of the connection flange 46 to enable a balanced lift of the vertical Christmas tree 50. A lift cap 101 for the TRAPT 40 will be connected to the top of the lubricator 48, same as for the pressure control head 47, and will be positioned in the centre to allow balanced lifting. (Shown in FIG. 11*bb*)

The Pressure control head 47 is positioned ideally directly to the centre of the annulus bore 60 to minimise angled pull on the slick line 49 because this could reduce the sealing capacity or damage the seals in the stuffing box.

Umbilicals 65 (shown in FIG. 5) having direct lines to operate the connection flange 46 and lines to control required functions of the Christmas tree 50.

Figure 5:
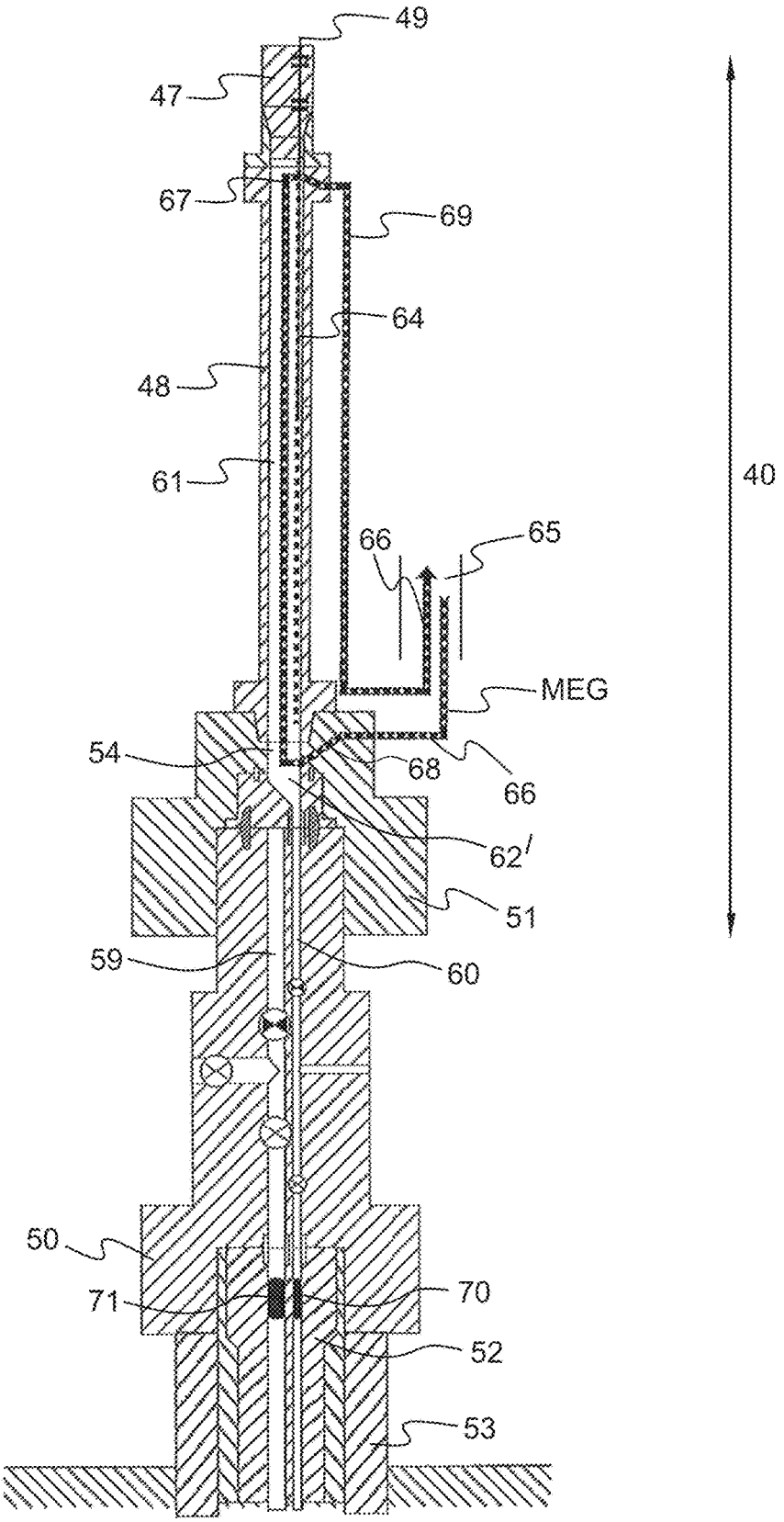
FIG. 5 is a schematic view of how the flushing of the lubricator is achieved via umbilical in the tree running and annulus plugging tool.

FIG. 5 shows schematically how the flushing of the lubricator 48 from FIG. 4 is achieved via the umbilical 65 in the tree running and annulus plugging tool (TRAPT) 40. For instance Mono Ethylene Glycol (MEG) or other fluid suitable for flushing the system, could be circulated through flushing lines 69. MEG is circulated from the umbilical 65, through a first flushing line to the Christmas tree adaptor connector 51 and further circulated through a passage line 68 in the Christmas tree adaptor connector 51 to the large bore 62 in the Christmas tree adaptor connector 51. MEG is then flushed through the large bore 61 in the lubricator 48 in order to remove any hydrocarbons in the large bore 61. MEG is further circulated through a return point 67 at the top of the lubricator 48 and back to the umbilical 65 through a return flushing line 69. Another purpose of the MEG flushing in the lubricator 48, is to fill the large bore 61 and 62 with MEG prior to pulling a plug in the annulus bore 60 in the tubing hanger 52, in order to avoid hydrate formation in case of pressure build up below the plug 70. The Christmas tree 50 could also be function and pressure tested through the umbilical 65.

Figure 6:
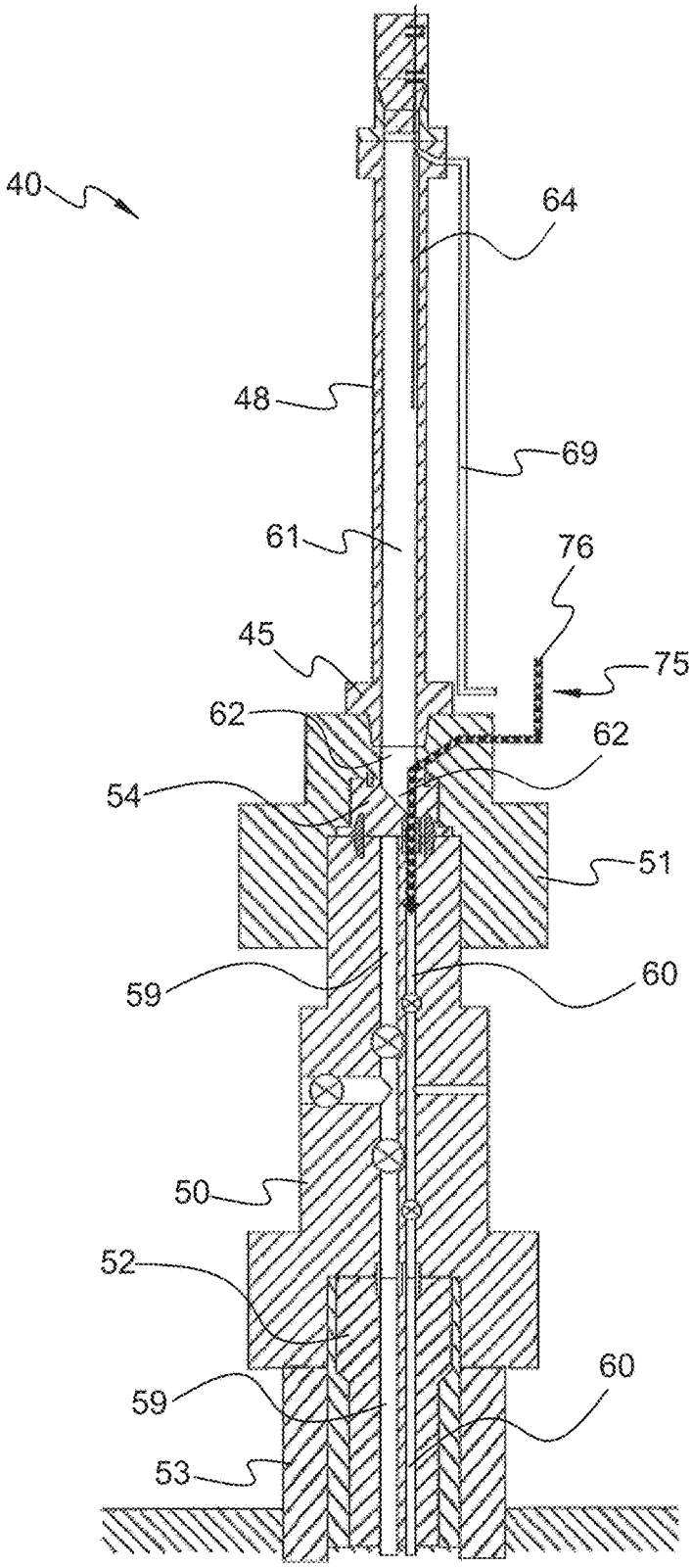
FIG. 6 is a schematic view of how well killing is achieved via hose connections.

FIG. 6 shows schematically the killing of a well. A kill fluid path 75 is extending from a kill hose 75 connected to the inlet of the passage 68 through the Christmas tree adaptor connector 51. A kill fluid 76 is circulated through this passage 68 into the annular passage 62 in the Christmas tree adaptor connector 51 and further down through the annulus bore 60 in the Christmas tree 50 to the annulus bore 60' in the tubing hanger 52 and further down to the annulus crossover valve (not shown). Then fluid needs to flow via a crossover path into the main bore to replace the fluid in the main bore. The purpose of the operation is to kill the well by placing a column of heavy fluid ie kill fluid 76 into well bores (production bore 59' or annulus bore 60') in order to prevent the flow of reservoir fluids without the need for pressure control equipment at the surface.

Figure 7:
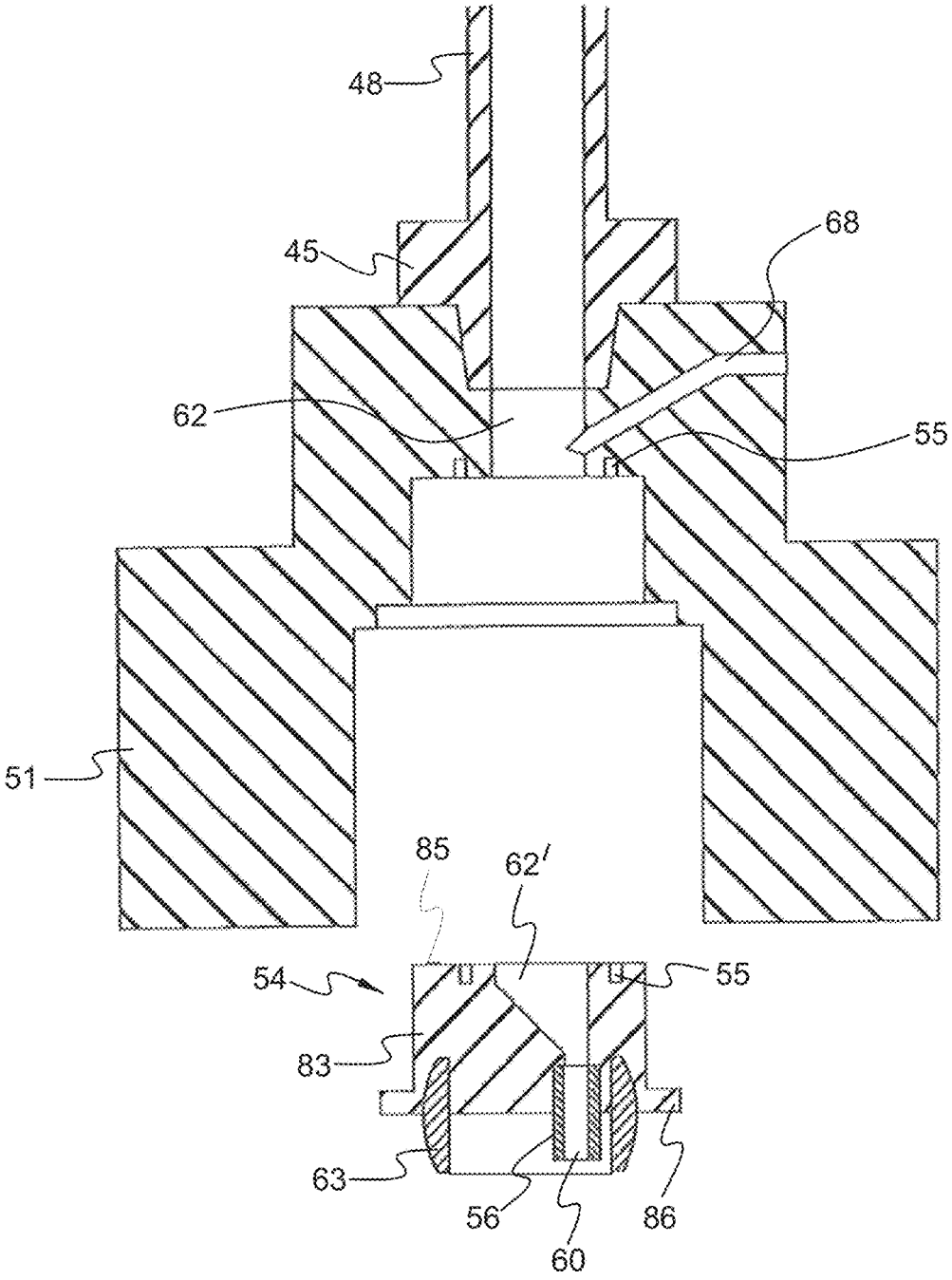
FIG. 7 is a schematic view of the Tree running and annulus plugging tool according to the invention with a replaceable interface and seal interface in the Christmas tree connector.

FIG. 7 shows schematically the replaceable member 54 in the Christmas tree adaptor connector 51 in detail. The replaceable member 54 is shown separate from the Christmas tree adaptor connector 51. An interface 85 between the replaceable member 54 and the Christmas tree adaptor connector 51 is sealed by standard metal seals 55 and the Christmas tree adaptor connector 51 and the replaceable member 54 are connected to each other with bolts (not shown). The large bore 62 in the upper part of the Christmas tree adaptor connector 54 and the corresponding opening of the upper interface of the large bore 62' in the replaceable member 54 having the same configuration and allows a straight access to all configurations of annulus bores 60 in the Christmas tree 50 from the large bore 62 in the lubricator 48. The replaceable member 54 is necked or funneled down to match the configuration of the annulus bore 60 in the Christmas tree 50. The large bore 62' in the replaceable member 54 is necked down in only one of the sides. Other possible embodiments of the necking is a conical necking on both sides of the large bore 54. The interface 86 between the replaceable member 54 and the Christmas tree 50 is sealed by Christmas tree specific seals 56 and 63.

The production bore 59 in the Christmas tree is closed by a massive portion 83 of the replaceable member 54.

The metal seal 55 prevents leakage between the Christmas tree adaptor connector 51 and the replaceable member 54, between the large bore 62 in the Christmas tree adaptor connector 51 and the large bore 62' in the replaceable member 54.

The seal 56 towards the Christmas tree 50 is for instance a stinger seal extending into the annulus bore 60 in the Christmas tree 50.

A second seal 63, for instance a metal TX seal is arranged around the outside of the Christmas tree production bore 59 and the Christmas tree annulus bore 60 to prevent leakage from the annulus bore 60 and the production bore 59 in the Christmas tree 50.

Figure 8:
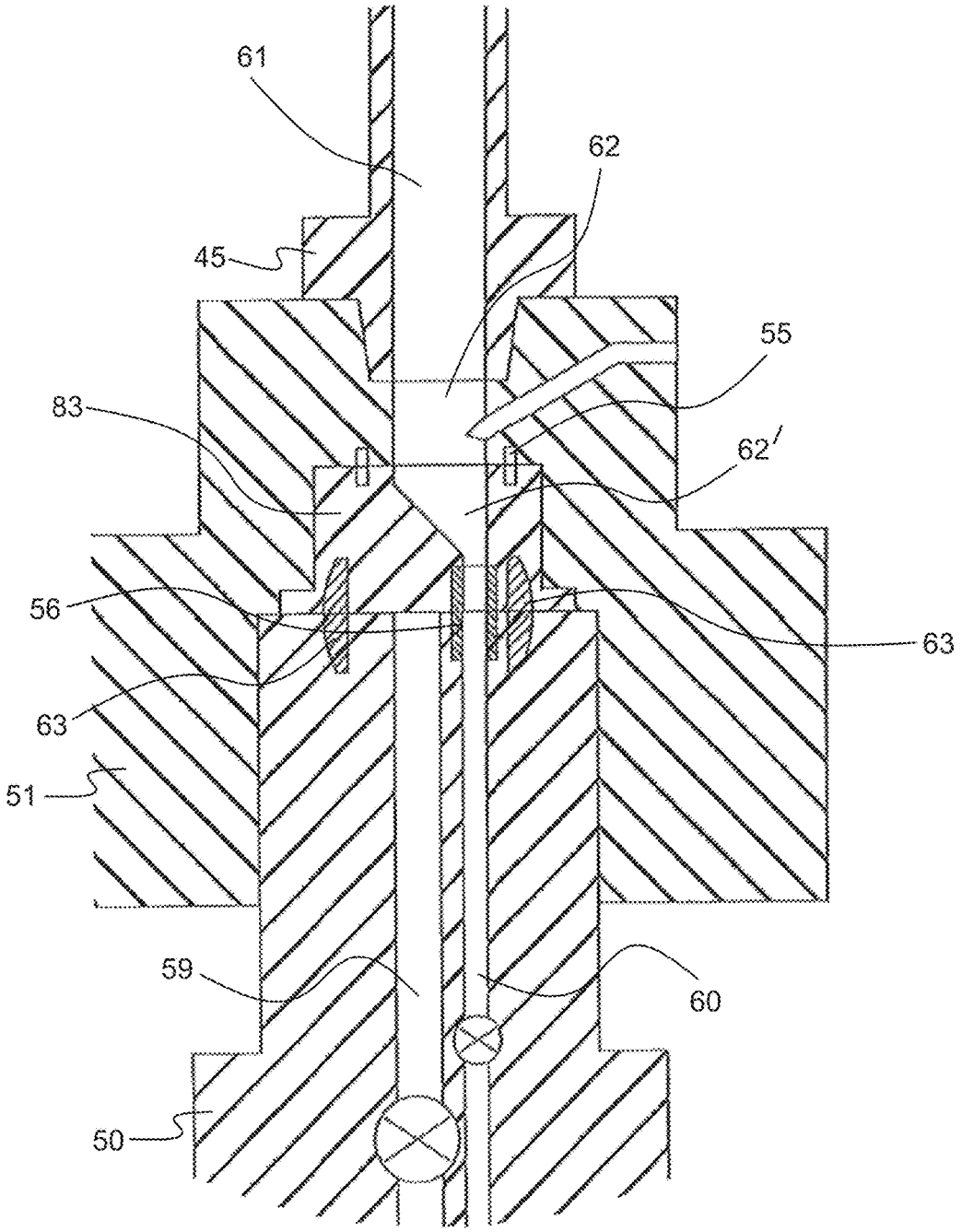
FIG. 8 is a schematic view of the changeable interface to the vertical H4 hub in detail.

FIG. 8 shows a schematic view of the same replaceable member 54 as shown in FIG. 7 arranged between the Christmas tree adaptor connector 51 and the Christmas tree 50. The seals 55, 56 and 63 are arranged between the components. The production bore 59 is blocked by the massive portion 83 and the outer seal 63.

Figure 9:
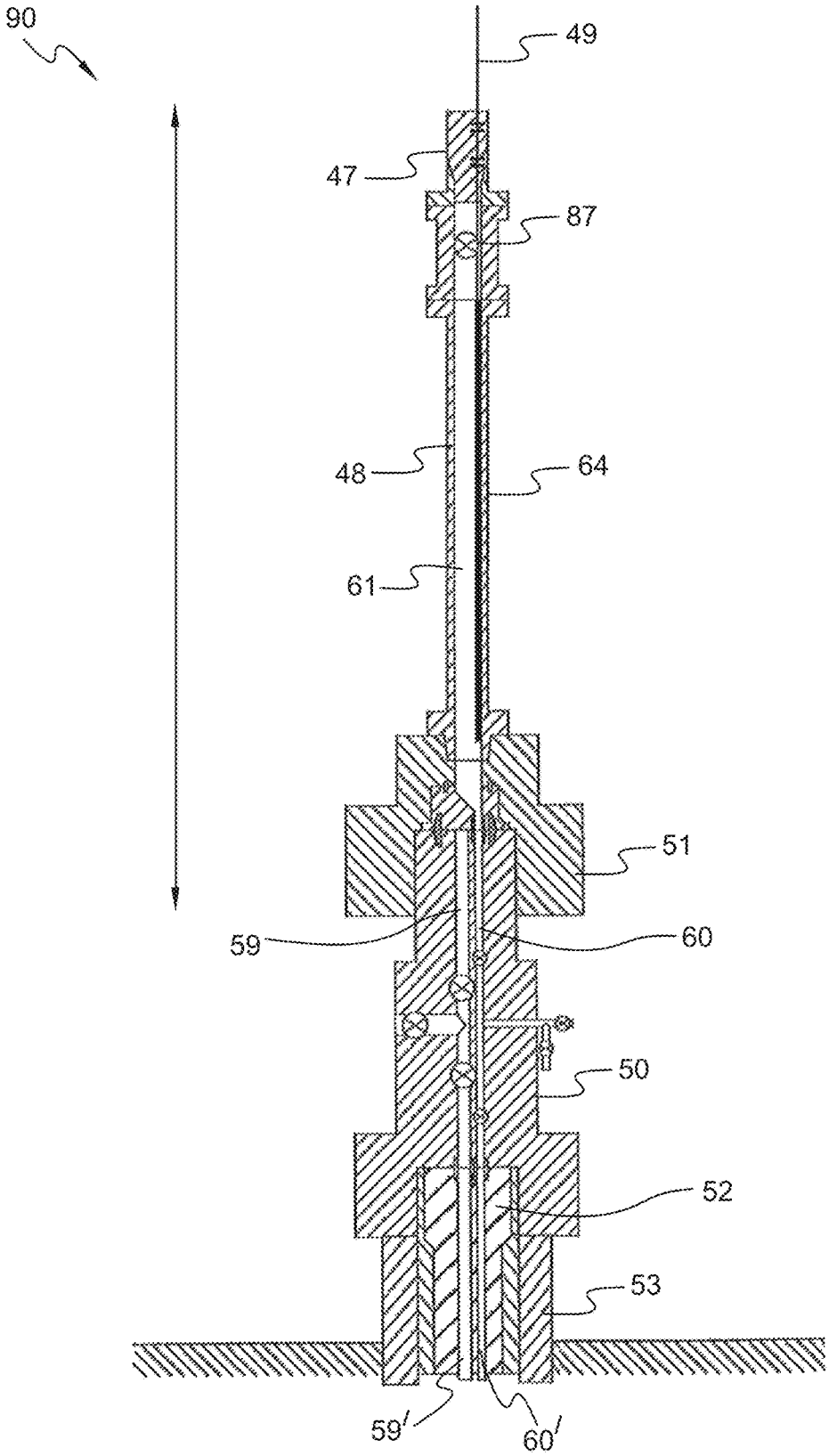
FIG. 9 is a schematic view of another possible embodiment of the tree running and annulus tool with a wireline shear seal valve.
Figure 10:
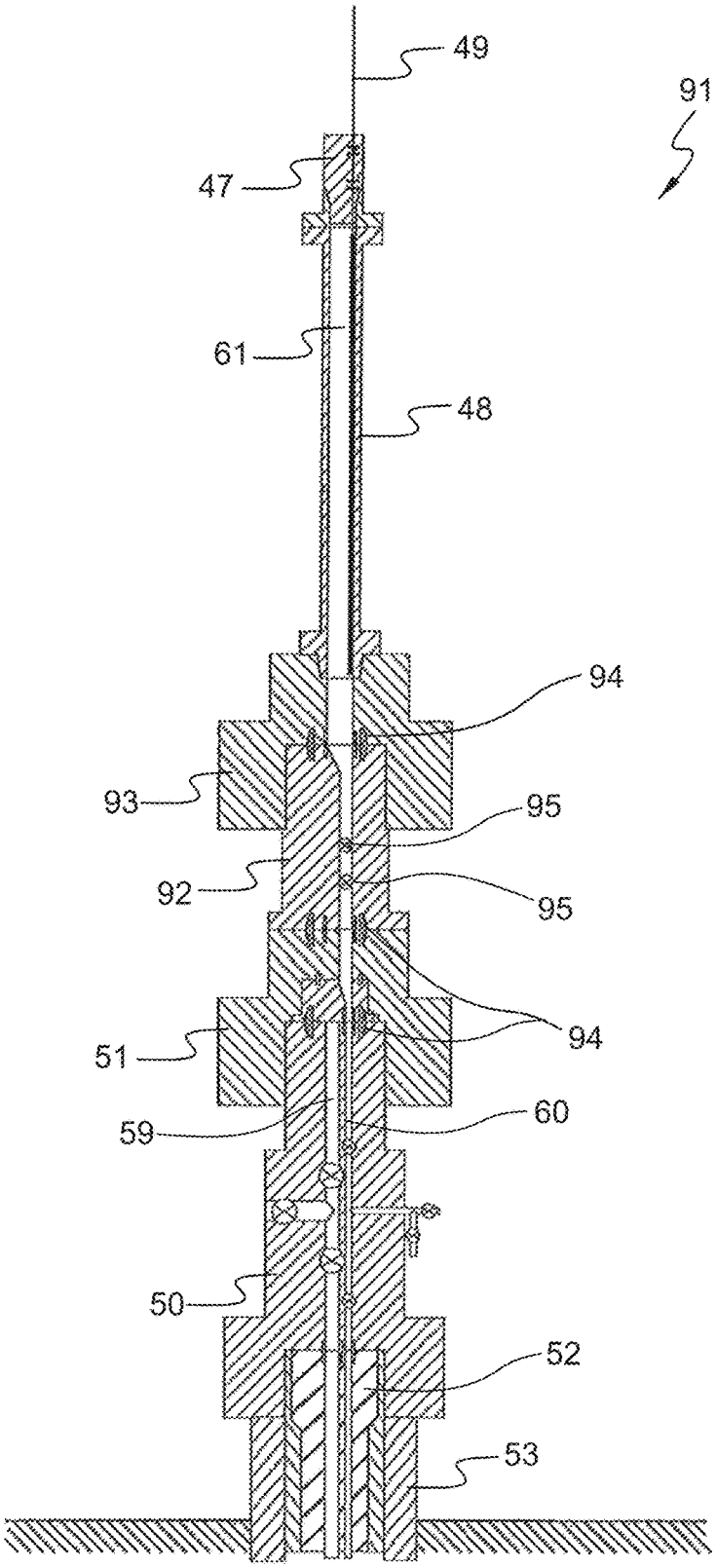
FIG. 10 is a schematic view of another possible embodiment of the tree running and annulus tool with a miniature lower riser package.

FIG. 9-FIG. 10 shows possible embodiments of the Tree running and annulus plugging tool (TRAPT) according to the present invention.

FIG. 9 shows a schematic view of a tree running and annulus plugging tool 90 with a wire shear seal valve 87 arranged between the pressure control head 47 and the lubricator 48. The wire shear seal valve 87 could also be positioned below the lubricator 48. If the valve 87 is positioned at the bottom of the lubricator 48 it should be capable of cutting the shear stem in the wireline tool string. Accumulators (not shown) are arranged on the outside of the lubricator 48. The valve 87 is adapted to cut the cable or wireline and seal the passage to the annulus bore 60 (or the production bore 59).

FIG. 10 shows a schematic view of an embodiment of the TRAPT 91 with a miniature lower riser package 92 arranged below the lubricator 48. There is arranged a standard H4 hub and connector 93 between the lubricator and the miniature lower riser package 92. The miniature lower riser package 92 is connected to the Christmas tree adaptor connector 51 with the replaceable member 54 at the lower interface.

Figure 2:
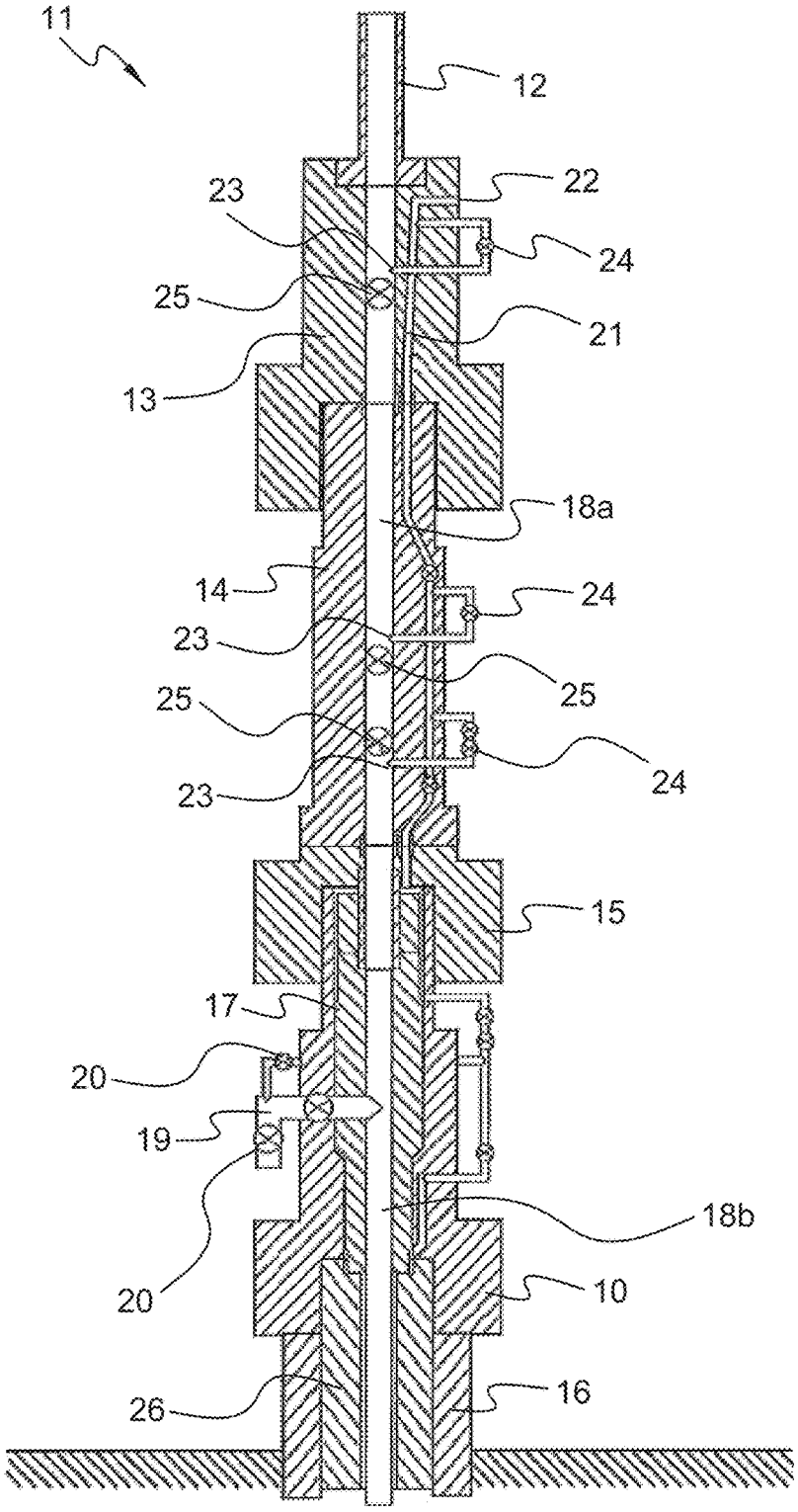
Fig. 2 (Prior Art)
FIG. 2 is a schematic view of a standard open water workover system on a horizontal Christmas tree according to prior art.

The miniature lower riser package 92 and Christmas tree adaptor connector 51 could have double souble shear seal rams and H4 profile towards each other. At the upper interface the miniature lower riser package 92 is connected to the standard H4 hub and connector 93 which in turn is connected to the lubricator 48. Seals 94 are arranged between the different components of the TRAPT 91. At the inside of the miniature lower riser package 92 there are arranged cutting valves 95 capable of cutting the shearable stem in a wireline or a cable operated tool. This arrangement allows the lubricator 48 to be disconnected and return to topside, leaving the top interface of the miniature lower riser package 92 for contingency operations with a riser system with emergency disconnect package 13 and lower riser package 14 (FIG. 2).

FIG. 11*a*-11*f* shows a schematic view of an operational sequence of a running procedure of vertical Christmas tree with use of the TRAPT for removing a Christmas tree according to the present invention. The TRAPT could also be used to remove other types of Christmas trees although this is not shown in the Figures. This being an embodiment of the invention.

Figures 11A, 11B, 11C:
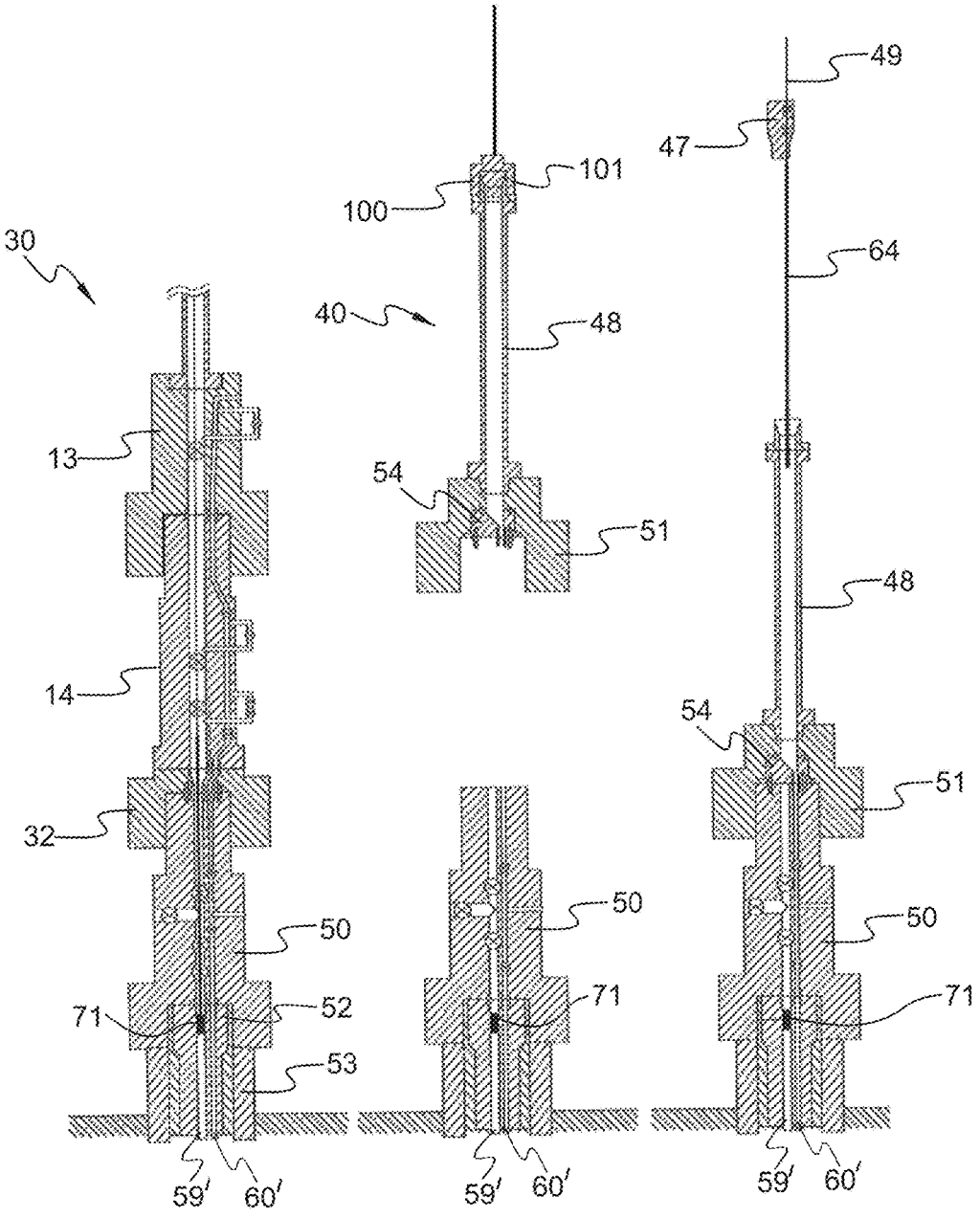
FIG. 11*a-f* are schematic view of the vertical Christmas tree procedure according to the present invention.

In FIG. 11*a* there is a standard workover system 30 (similar to the workover system shown in FIG. 3) with the EDP 13, the LRP 14 and the XTAC/passive bore selector 32 attached to the Christmas tree 50. This workover system will set a plug 71 in the production bore 59' in the tubing hanger 52. The workover system is then removed from the Christmas tree 50.

A lifting sub 100 is lowering the TRAPT 40 on top of the Christmas tree 50. This is shown in FIG. 11*b*.

FIG. 11*c* shows the TRAPT connected to the Christmas tree 50. The annulus bore 60' in the tubing hanger 52 is plugged using a second tool that is attached to the slick line or cable 49 and that is delivered with the pressure control head 47 and guided through the lubricator 48, XTAC 51 with the replaceable member 54 and the Christmas tree 50 to the tubing hanger 52.

Figures 11D, 11E, 11F:
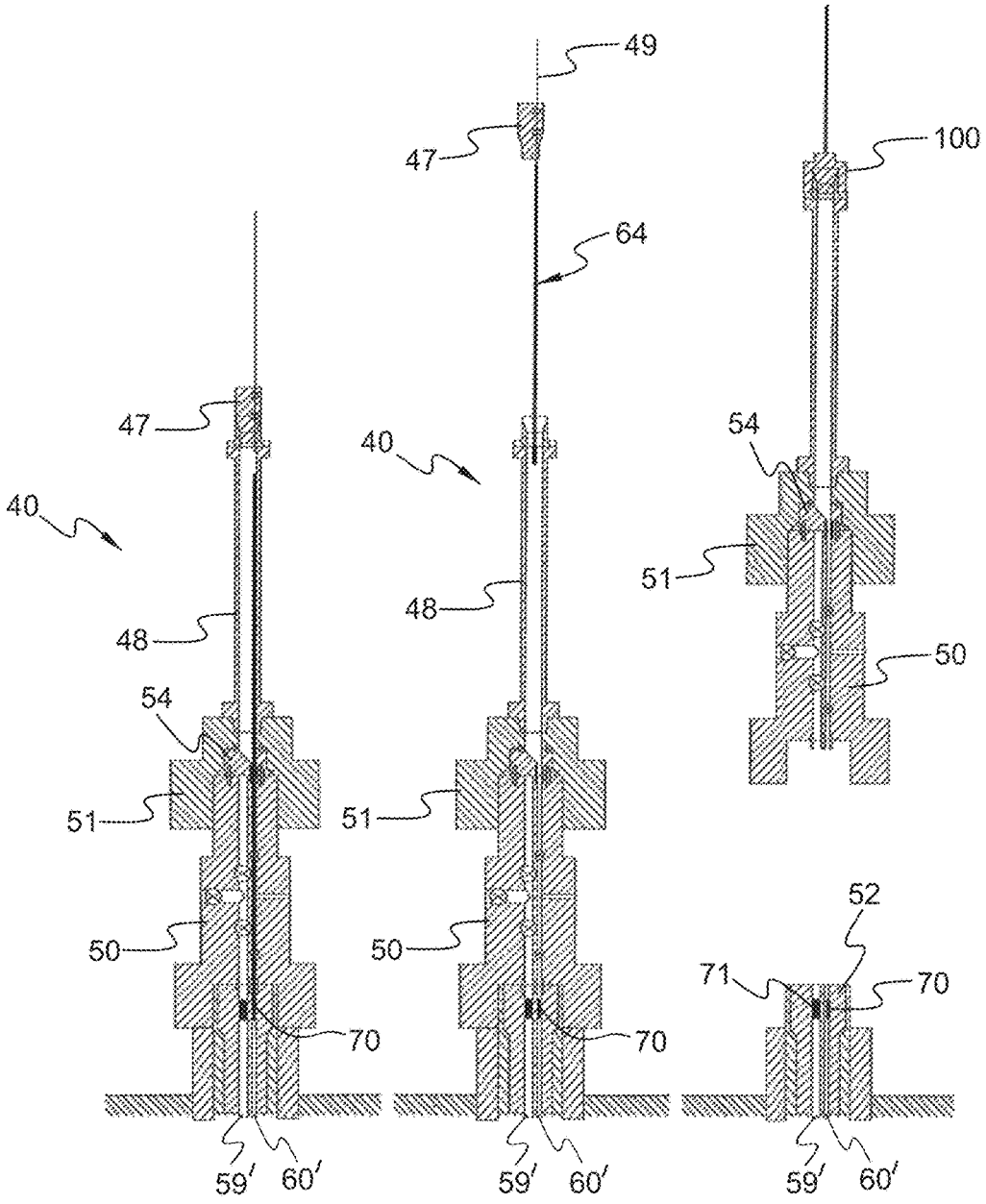

FIG. 11*d* shows the annulus bore plug 70 installed in the annulus bore 60' in the tubing hanger 52.

The tool 64 and the pressure control head 47 are removed from the TRAPT 40. This operation is shown in FIG. 11*e*.

In FIG. 11*f* the lifting sub is again attached to the TRAPT 40 and the vertical Christmas tree 50 is pulled away from the tubing hanger 52 and well head 53 by the TRAPT.

The reverse operational sequence of running procedure of vertical or horizontal Christmas tree with use of the TRAPT could be performed for installing the Christmas tree on the wellhead by performing the reverse action of the steps in FIG. 11*a*-11*f*.

The present invention has been described with reference to preferred embodiments and aspects thereof and related to the accompanying drawings for the sake of understanding only and it should be obvious to persons skilled in the art that the present invention includes all legitimate modifications within the ambit of what has been described hereinbefore and claimed in the attached claims.

The invention claimed is:

1. A multipurpose tool arrangement for riserless intervention of a subsea well, the multipurpose tool arrangement comprising:

a multipurpose tool comprising a tubular element and a Christmas tree adaptor connected to a lower end of said tubular element, the Christmas tree adaptor adapted to be connected at a lower end of the Christmas tree adaptor to a Christmas tree, said Christmas tree adapted to land on a wellhead having a tubing hanger, an annulus bore being defined through said tubing hanger; and a connection flange arranged at a top of said tubular element, the connection flange adapted to be selectively connected to a lifting member when removing or installing said Christmas tree on said wellhead with the multipurpose tool and the lifting member and the connection flange adapted to be selectively connected to a pressure control head comprising a cable operated second tool when installing or retrieving a plug in said tubing hanger annulus bore through the multipurpose tool and the Christmas tree with the cable operated second tool.

2. The multipurpose tool according to claim 1, wherein a large bore being defined through said tubular element having a diameter substantially similar to a circle circumscribing a production bore and an annulus bore in said Christmas tree.

3. The multipurpose tool according to claim 1, wherein said tubular element comprises the connection flange for releasable receiving said lifting member.

4. The multipurpose tool according to claim 1, wherein a cable extends through pressure controlling elements in the pressure control head which prevents leakage of gases or liquids along the cable.

5. The multipurpose tool according to claim 4, wherein said pressure control head has a check valve which is adapted to close a cable bore if the cable is broken.

6. The multipurpose tool according to claim 4, wherein said cable is a slick line.

7. The multipurpose tool according to claim 1, wherein said Christmas tree adapter comprises a Christmas tree adaptor connector and a replaceable inner member.

8. The multipurpose tool according to claim 1, wherein a Christmas tree annulus bore is defined through said Christmas tree, said Christmas tree annulus bore being in communication with said tubing hanger annulus bore.

9. The multipurpose tool according to claim 7, wherein the replaceable inner member having a fixed upper interface with said Christmas tree adaptor connector and a lower interface with said Christmas tree, the lower interface, together with the pressure control head being configured to fit each specific configuration of a production bore and an annulus bore of said Christmas tree.

10. The multipurpose tool according to claim 1, wherein said pressure control head is replaceable and connected to an upper interface of the cable operated second tool.

11. The multipurpose tool according to claim 1, wherein an opening in said pressure control head for a cable is positioned directly vertical of the tubing hanger annulus bore to be intervened, allowing a straight access for said cable operated second tool to a Christmas tree annulus bore.

12. The multipurpose tool according to claim 1, wherein said multipurpose tool having a shear valve adapted to cut a cable and seal a passage from a Christmas tree annulus bore or a Christmas tree production bore.

13. The multipurpose tool according to claim 1, wherein in a miniature lower riser package is arranged between the tubular element and the Christmas tree.

14. The multipurpose tool according to claim 1, wherein said multipurpose tool is dimensioned to carry weight of a complete Christmas tree.

15. The multipurpose tool according to claim 2, wherein said multipurpose tool having flushing lines for circulating MEG through said large bore in said tubular element.

16. The multipurpose tool according to claim 7, wherein MEG is circulated from an umbilical through a first flushing line, through a passage line in said Christmas tree adaptor connector, through a large bore in the Christmas tree adaptor connector and said annulus bore in said tubular element, said MEG is circulated back to the umbilical through a return point in the top of said tubular element and a return flushing line.

17. The multipurpose tool according to claim 1, wherein said multipurpose tool having lines for killing the subsea well with killing fluid.

18. A method for riserless removal of a Christmas tree from a wellhead having a tubing hanger, said tubing hanger having a production bore and an annulus bore, the method comprises a standard plugging in said tubing hanger production bore with a standard workover system, the method comprising:

removing the standard workover system, lowering a multipurpose tool with a lifting member attached to a connection flange at a top of said multipurpose tool, connecting the multipurpose tool to the Christmas tree, removing the lifting member from the connection flange and attaching a pressure control head with a cable operated second tool to the connection flange at the top of the multipurpose tool, plugging of the tubing hanger annulus bore with said cable operated second tool, removing the pressure control head from the connection flange and attaching the lifting member to the connection flange at the top of the multipurpose tool, removing of the Christmas tree from the wellhead with the multipurpose tool and the lifting member.

19. A method for installing a Christmas tree on a subsea well comprising a tubing hanger landed in a wellhead, said tubing hanger having a production bore and an annulus bore wherein the method comprising the following steps:

connecting a multipurpose tool to the Christmas tree, connecting a lifting member to a connection flange at a top of the multipurpose tool, lowering the multipurpose tool with the Christmas tree to the wellhead, connecting the Christmas tree to the wellhead, removing the lifting member from the connection flange and connecting a pressure control head with a slick line operated second tool to the connection flange at the top of the multipurpose tool, removing a plug from the tubing hanger annulus bore with said slick line operated second tool, removing the pressure control head from the connection flange and connecting the lifting member to the connection flange at the top of the multipurpose tool, removing the multipurpose tool with use of the lifting member, lowering a standard workover system to the Christmas tree for removing a plug in the tubing hanger production bore.

* * * * *